US008820235B2

(12) United States Patent
Toyoda et al.

(10) Patent No.: US 8,820,235 B2
(45) Date of Patent: Sep. 2, 2014

(54) JACKET FOR IMPRESSION CYLINDER OR TRANSPORT CYLINDER OF PRINTING PRESS

(75) Inventors: Hideaki Toyoda, Tsukuba (JP); Fusao Yamada, Tokyo (JP)

(73) Assignee: Komori Corporation, Tokyo (JP)

( * ) Notice: Subject to any disclaimer, the term of this patent is extended or adjusted under 35 U.S.C. 154(b) by 474 days.

(21) Appl. No.: 11/584,597

(22) Filed: Oct. 23, 2006

(65) Prior Publication Data

US 2007/0089622 A1 Apr. 26, 2007

(30) Foreign Application Priority Data

Oct. 24, 2005 (JP) ..... 2005-308677

(51) Int. Cl.
*B41F 22/00* (2006.01)
*B41F 30/02* (2006.01)

(52) U.S. Cl.
USPC ..... 101/422; 101/409; 101/416.1; 101/475

(58) Field of Classification Search
USPC ..... 101/409, 416.1, 422, 475
See application file for complete search history.

(56) References Cited

U.S. PATENT DOCUMENTS

| | | | | |
|---|---|---|---|---|
| 5,190,837 | A * | 3/1993 | Sakai et al. | 430/58.05 |
| 6,811,863 | B2 * | 11/2004 | Rizika et al. | 428/304.4 |
| 2002/0073860 | A1 * | 6/2002 | Blumm et al. | 101/232 |
| 2003/0015111 | A1 * | 1/2003 | Rizika et al. | 101/416.1 |
| 2005/0011592 | A1 * | 1/2005 | Smith | 148/519 |
| 2005/0089706 | A1 * | 4/2005 | Urata et al. | 428/546 |

FOREIGN PATENT DOCUMENTS

| | | | |
|---|---|---|---|
| JP | 58-167197 | A | 10/1983 |
| JP | 8-48087 | A | 2/1996 |
| JP | 08048087 | A * | 2/1996 |
| JP | 11-105249 | A | 4/1999 |
| JP | 2001-260561 | A | 9/2001 |
| JP | 2003-335075 | A | 11/2003 |
| JP | 2005-1321 | A | 1/2005 |

* cited by examiner

*Primary Examiner* — Judy Nguyen
*Assistant Examiner* — Blake A Tankersley
(74) *Attorney, Agent, or Firm* — Birch, Stewart, Kolasch & Birch, LLP

(57) ABSTRACT

Provided is a jacket to be installed on a surface of one of impression cylinders and transport cylinders. The jacket is produced by the following process. Super hard particles, such as ceramic particles, are scattered on a surface of a sheet-shaped base member. A plating layer is then formed on the surface of the base member in a way that a convex and concave profile formed of the super hard particles is left. In the plating layer, fine particles of low surface energy resin are uniformly dispersed.

19 Claims, 5 Drawing Sheets

JACKET FOR IMPRESSION CYLINDER OR TRANSPORT CYLINDER OF PRINTING PRESS

BACKGROUND OF THE INVENTION

1. Field of the Invention

The present invention relates to a jacket for preventing ink from adhering to an impression cylinder or a transport cylinder of a printing press, the jacket being wound around and installed on, the impression cylinder or the transport cylinder.

2. Description of the Related Art

An example of a printing press which makes prints on both surfaces of a sheet of paper or the like is shown in FIG. 5. This printing press is a sheet-fed rotary printing press for making prints on both sides of paper. The printing press is configured of a sheet feeder 101, a printing unit 102, and a paper delivery unit 103. Sheets of paper stacked in the sheet feeder 101 are removed therefrom sheet-by-sheet. The sheets are then supplied to the printing unit 102 by the support of a register board 104, a swing gripper 105, and a transport cylinder 106.

The printing unit 102 is configured of four front side printing units 107A, 107B, 107C, and 107D, and four back side printing units 108A, 108B, 108C, and 108D. The front side printing units 107A to 107D are provided for first to fourth colors, respectively. Each of the front side printing units 107A to 107D is configured of a blanket cylinder (a rubber cylinder) 110*a*, a plate cylinder 111*a*, and an inking device (not shown), which are provided on each of upper portions of impression cylinders 109*a*. Each of the upper portions of the impression cylinders 109*a* includes a sheet gripper. Likewise, the back side printing units 108A to 108D are provided for the first to fourth colors, respectively. Each of the back side printing units is configured of a blanket cylinder (a rubber cylinder) 110*b*, a plate cylinder 111*b*, and an inking device (not shown), which are provided on each of lower portions of impression cylinders 109*b*. Each of the lower portions of the impression cylinders 109*b* includes a sheet gripper.

The front side printing units 107A to 107D and the back side printing units 108A to 108D are sequentially connected with one another in the following manner. The front side printing unit 107A of the first color is positioned first to make a print, and the back side printing unit 108A of the first color is positioned next to the front side printing unit 107A, and then, the front side printing unit 107B of the second color is positioned next to the back side printing unit 108B.

A sheet of paper fed from the sheet feeder 101 is transferred to the impression cylinder 109*a* of the first front side printing unit 107A. The transferred sheet is then pressed by the impression cylinder 109*a* toward the blanket cylinder 110*a*, and thus a print of the first color is made on the front side of the sheet. Subsequently, the sheet of paper is transferred to the impression cylinder 109*b* of the first back side printing unit 108A. The sheet is then pressed by the impression cylinder 11*a* toward the blanket cylinder 110*b* and thus a print of the first color is made on the back side of the sheet. Thereafter, as in the aforementioned manner, prints of the second to fourth colors are alternately made on the front and back sides of the sheet of paper by the second to fourth front side printing units 107B to 107D, and the second to fourth back side printing units 108B to 108D. After the prints are completed, the sheet of paper is transferred from the impression cylinder 109*b*, which is of the last unit, to a transport cylinder 112 and then is discharged from the paper delivery unit 103. Such a printing press for making prints on both sides of a sheet of paper is disclosed in Japanese Unexamined Patent Application Publication No. 11-105249, for example.

In such a printing press for making two-sided prints, the impression cylinders other than the impression cylinder 109*a* located at the most upstream in the operation, press the printed surfaces. Specifically, the surfaces where the ink is attached are pressed to the blanket cylinders 110*a*, and 110*b*. The ink thus adheres to the impression cylinders 109*a* and 109*b*. Accordingly, the ink adhering to the impression cylinders 109*a* and 109*b* adheres onto a printed material (the sheet of paper) to be processed thereafter. The attached ink on the printed material causes smearing on the printed material, and leads to a concern that the smearing on the printed material makes the printed material a failure.

In FIG. 6, an aspect of how the ink adheres to the printed material is schematically shown. The front side of a sheet of paper 113 is pressed by the impression cylinder 109*a* toward the blanket cylinder 110*a* of the first front side printing unit 107A. A piece of ink 114*a* is then placed on the front side of the sheet of paper 113, that is, a print is made. Next, in the first back side printing unit 108A, the back side of the sheet of paper 113 is pressed by the impression cylinder 109*b* toward the blanket cylinder 110*b*. A piece of ink 114*b* is then placed on the back side of the sheet of paper 113. At this time, the piece of ink 114*a* placed on the front side of the sheet of paper 113, is transferred to the impression cylinder 109*b*. Subsequently, the transferred ink moves to a sheet of paper which comes next. As a result, the printed material is smeared. It should be noted that the occurrence of such a problem is not limited in printing presses making prints on both sides of paper. The problem also occurs in a case where a print is made on the back side of a sheet of paper by reversing the front side of the sheet of paper after a print on the front side of the sheet of paper is made in a printing press having a function of sequentially making prints on both sides of paper. Furthermore, a similar problem also occurs with the transport cylinder 112, although the extent of the problem is not as much as with the impression cylinder 109*b* which presses the sheet of paper 113 toward the blanket cylinder 109*b*. This is because the transport cylinder 112 transports the sheet of paper 113 in a state where the printed surface of the sheet of paper 113 faces the front surface of the cylinder. Incidentally, such a transport cylinder described above includes intermediate cylinders 110 shown in FIG. 2 of Japanese Unexamined Patent Application Publication No. 11-105249 which is mentioned above. The above described transport cylinder also includes intermediate cylinders and transfer cylinders which transport a sheet of paper between each of impression cylinders of a printing unit in a single-side printing press.

In order to prevent such smearing on printed materials, as shown in FIG. 7, the following technique has been considered. Jackets 120 resistant to the adhesion of ink are installed onto the impression cylinders 109*a* positioned to make prints after the second front side printing unit 107B, the impression cylinders 109*b* of all the back sides printing units 108A to 108D, and the front surface of the transport cylinder 112, respectively, has been considered (Japanese Unexamined Patent Application Publication No. 2003-335075). The jacket disclosed in Japanese Unexamined Patent Application Publication No. 2003-335075 is formed in the following manner. A ceramic thermal sprayed layer 122 is formed on a base member 121 by means of thermal spray. Sequentially, a coating of a low surface energy resin 123, which is a silicone-based resin, is made thereon. Reference numeral 124 denotes holes formed in the ceramic thermal sprayed layer 122.

As shown in FIG. 8, the jacket 120 disclosed in Japanese Unexamined Patent Application Publication No. 2003-335075 is formed by forming the ceramic thermal sprayed layer 122 by means of the thermal spray on the base member 121. It is, however, not easy to form a ceramic layer having a uniform film thickness, in any way. Moreover, in order to closely attach a ceramic onto the base member 121 made of a metallic plate or the like, it is necessary to provide a metal thermal sprayed layer 125 therebetween. For this reason, the productivity thereof is not good.

Furthermore, the jacket 120 described in Japanese Unexamined Patent Application Publication No. 2003-335075 needs to be frequently replaced with another. This is because the low surface energy resin 123 on the surface of the jacket 120 tends to be separated therefrom and to be worn out. Moreover, since the low surface energy resin 123 is relatively soft, paper dust or other dust easily enters therein. In addition, since the electrostatic property of the low surface energy resin 123 is not good, the low surface energy resin 123 tends to be electrostatically charged. Accordingly, paper dust or other dust is likely adsorbed to the low surface energy resin 123. When ink adheres to the adsorbed paper dust or other dust, ink smearing is generated in a short period of time. It should be noted that since the ceramic thermal sprayed layer is thermally sprayed on the base member 121 made of a metallic plate or the like, there is another problem where the base member 121 having been used once cannot be used again.

The present invention solves the aforementioned problems in the conventional jackets. The present invention provides a jacket for an impression cylinder or a transport cylinder, which jacket makes the impression cylinder or the transport cylinder resistant to the attachment of ink as a matter of course. Furthermore, the present invention provides the jacket with durability as well as a simple manufacturing process, which makes the impression cylinder or the transport cylinder resistant to the attachment of paper dust or the like.

SUMMARY OF THE INVENTION

The present invention is directed to a jacket for an impression cylinder or a transport cylinder of a printing press, which is wound therearound and installed thereon. The jacket is formed in the following manner. Super hard particles are scattered on a surface of a sheet-shaped base member. Then, the surface of the base member is plated (composite plating) with metal in a way that a convex and concave profile of the super hard particles is left. The metal contains fine particles of low surface energy resin.

As the super hard particles, for example, ceramic particles, amorphous alloy particles, or diamond particles are adopted. Furthermore, particles of elements such as tungsten, molybdenum, particles of oxide or carbide elements such as tungsten, molybdenum, boron, aluminum, titanium, or silicon, or glass particles are also adapted as the super hard particles.

A low surface energy resin is a resin having a small surface free energy. In the present invention, it is defined as a resin, which is resistant to the adhesion of ink, and which easily repels the ink. As the low surface energy resin, the following can be cited as examples: tetrafluoroethylene resin (PTFE), tetrafluoroethylene-perfluorovinyl ether copolymer (PFA), tetrafluoroethylene-hexafluoropropylene copolymer (FEP), ethylene-tetrafluoroethylene copolymer (ETFE), polyvinylidene fluoride (PVDF), trifluorochloroethylene resin (PCTFE), and furthermore, graphite fluoride, or the like. Among these examples, PTFE is desirable since it contains the lowest surface energy (18 dyn/cm) among the solids.

As the metal to be adapted as composite plating, nickel-phosphorus (Ni—P), nickel (Ni), nickel-boron (Ni—B), and the like can be cited as examples. Incidentally, as a method of plating, it is possible to use any of electroplating, and electroless plaiting.

The composite plating using the fine particles of low surface energy resin is processed with a thickness which enables the super hard particles to be firmly retained onto the base member, depending on the shape of super hard particles.

The jacket for an impression cylinder or a transport cylinder of a printing press according to the present invention, ink smearing hardly occurs. It is because the super hard particles are configured to press a print medium such as paper or film, that is, each of points at which to press the medium is a minimum point. Since the super fine particles are adapted, a degree of wear-out is small in comparison with the low surface energy resin, and durability thereof is also high. The super hard particles are retained on the surface of the jacket by the composite plating. For this reason, removal and separation of the super hard particles therefrom hardly occurs. Furthermore, since the composite plating contains the low surface energy resin, the low surface energy properties are secured, and thus the composite plating becomes resistant to the ink adhesion. Moreover, since the matrix of the composite plating is metal, the composite plating is resistant to the adhesion of paper dust or the like. In addition, the manufacturing of the jacket itself is also easy since the means of thermal spray is not necessary.

Furthermore, the jacket for an impression cylinder or a transport cylinder of a printing press according to the present invention is a jacket which is wound therearound and installed thereon for preventing the ink adhesion. The jacket is formed in the following manner. Super hard particles are scattered on a surface of a sheet-shaped base member. Then, the super hard particles are fixed onto the base material by plating. Subsequently, a surface of the plating is coated with composite plating using fine particles of low surface energy resin in a way that a convex and concave profile of the super hard particles is left.

In this invention, the plating and the composite plating are processed in a manner where the platings with a thickness which enables the super hard particles to be firmly retained.

In the case of the jacket for an impression cylinder or a transport cylinder of a printing press according to the present invention, first, ceramic particles are retained onto the base member by the plating only, and then, the composite plating using fine particles of low surface energy resin is processed thereon. Thus, the thickness of the composite plating can be thin, and a usage of the expensive low surface energy resin can be small. Furthermore, as the first plating, metal only for fixing the super hard particles as an object can be used without taking dispersibility or the like into consideration. Thus, it is possible to firmly retain the ceramic particles further.

BRIEF DESCRIPTION OF THE DRAWINGS

The present invention will become more fully understood from the detailed description given hereinbelow and accompanying drawings which are given by way of illustration only, and thus are not limitation of the present invention, and wherein.

DETAILED DESCRIPTION OF THE INVENTION

A description will be made below in detail of a jacket for an impression cylinder or a transport cylinder of a printing press according to the present invention by use of Examples with reference to the drawings.

Example 1

Figure 1:
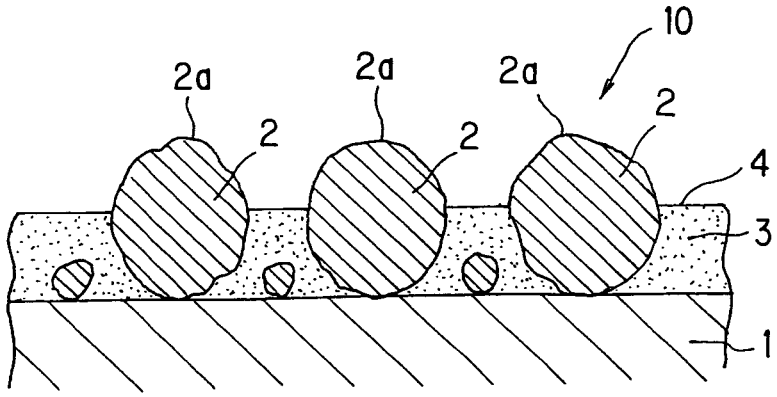
FIG. 1 is a partial cross sectional view of a jacket according to an example (Example 1) of the present invention, for an impression cylinder or a transport cylinder of a printing press.

As shown in FIG. 1, super hard particles 2 are scattered on a sheet-shaped base member 1. As the sheet-shaped base member 1, for example, a stainless steel plate or a corrosion-resistant metal plate of aluminum or the like is adapted. As the super hard particles 2, the following particles can be used; ceramic particles, amorphous alloy particles, diamond particles, tungsten particles, and molybdenum particles, and furthermore, particles of oxide or carbide tungsten, molybdenum, boron, aluminum, titanium, and silicon, or particles of glass.

The super hard particles 2 having an average particle diameter in a range from 3 μm to 30 μm are adapted. In a case where the super hard particles 2 having an average particle diameter less than 3 μm are used, the surface roughness of the jacket becomes too small. For this reason, the ink adheres to the surface of the jacket, causing smearing. On the other hand, when the average particle diameter of the super hard particles 2 is greater than 30 μm, the surface roughness of the jacket becomes too large. Tips of convex portions of the super hard particles thus damage the printed material itself, such as paper or cloth. As a result, a normal printed material cannot be produced. An optimal particle diameter of each of the super hard particles 2 is in a range from 10 μm to 20 μm.

The super hard particles 2 are scattered in a manner that an adequate space is provided between each two neighboring particles, but not in a manner that no space is provided therebetween. As a shape of each of the ceramic particles 2, for example, a shape having a rounded smooth surface. Furthermore, a spherical shape or the like is adapted. Specifically, roundish alumina AS series manufactured by Showa Denko K.K. and spherical alumina fine particles manufactured by MICRON Co., Ltd, can be adapted.

Composite plating in which fine particles 3 of low surface energy resin are uniformly dispersed is applied onto the base member 1, so that the base member 1 is coated with a plating layer (composite plating layer) 4. The composite plating layer 4 covers a half or more of the surface of each super hard particle 2 in a way that a convex and concave profile of the super hard particles 2 is left. Specifically, the composite plating layer 4 is formed in a way that the degree of surface roughness of concave and convex profile of the super hard particles 2, which is denoted by Rz, is 5 μm to 40 μm. The reason for the surface roughness Rz to be 5 μm to 40 μm is as follows. When the surface roughness of the jacket is smaller than 5 μm, the area of surface thereof which contacts with a surface of the printed material becomes larger. Accordingly, ink adheres to the surface of the jacket, and smearing is thus made on the surface in a case where the jacket is formed in the above manner. On the other hand, when the surface roughness is greater than 40 μm, the tips of convex portions of the super hard particles damage the printed material itself, such as paper. As a result, a normal printed material cannot be made. More preferably, the surface roughness of convex and concave profile formed by the super hard particles 2, which is denoted by Rz, is 15 μm to 30 μm.

In order to firmly fix the super hard particles onto the base member 1, it is desirable that a half or more of height of each of the super hard particles be covered with the plating. In order to more firmly fix the super hard particles 2 onto the metal plate 1, it is desirable that approximately 55% to 65% of the height of the particle having an average particle diameter be covered with the plating. A thickness of the plating is easily adjusted by, for example, adjusting a plating time, although depending on the plating method.

The super hard particles 2 are fixed onto the base material 1 by the composite plating layer 4 whose matrix is metal, in which the fine particles 3 of low surface energy resin are dispersed. Accordingly, each of the super hard particles 2 is firmly retained on the base member 1. It should be noted that, in a case where electroless plating is used, hardness of the matrix can be increased (Hv500 to Hv900) by performing a thermal treatment. Wear resistance can be thus improved.

A pitch between convex portions of neighboring super hard particles 2 which form a convex and concave profile is adjustable by changing the rate of content of the super hard particles 2. When the pitch width thereof is too small, a contact area of each of the super hard particles 2 becomes larger, and too many white spots are thus generated. When the pitch width is too large, the sheet of paper 112 is directly brought into contact with a large number of portions of the composite plating layer 4. Accordingly, ink smearing is generated, resulting in degradation of the print quality. For this reason, it is desirable that the pitch width be between 50 μm and 100 μm.

In this example, as the composite plating 4, a nickel-phosphorus alloy (Ni—P) is adapted as the fine particles 3 of low surface energy resin, the nickel-phosphorus alloy (Ni—P) being obtained by solidifying tetrafluoroethylene resin (PTFE) by eutectic transformation. As the fine particles 3 of low surface energy resin, a fluorine resin, such as tetrafluoroethylene-perfluorovinyl ether copolymer (PFA), tetrafluoroethylene-hexafluoropropylene copolymer (FEP), ethylene-tetrafluoroethylene copolymer (ETFE), polyvinylidene fluoride (PVDF), trifluorochloroethylene resin (PCTFE), or furthermore, graphite fluoride, or the like is used, other than tetrafluoroethylene resin (PTFE). PTFE is desirably used since it contains the lowest surface energy (18 dyn/cm) among the solids.

As metal in which PTFE fine particles or the like are dispersed, that is, as a matrix of the plating, for example, nickel (Ni), nickel-boron (Ni—B), or the like can be adapted other than nickel-phosphorus (Ni—P). As the composite plating 4, plating in which the particles 3 of low surface energy resin such as a fluorine resin is used in volume ratio of 10% to 60% with respect to the matrix is adapted. The reason for setting the volume ratio of the low surface energy resin of the particles 3 for the matrix to be 10% to 60% is that when the volume ratio is smaller than 10%, the ink repelling force of the plating becomes weaker. As a result, ink adheres to the surface of the plating, that is, the surface of the jacket, resulting in smearing on the surface of the jacket. On the other hand, today, it is technically difficult to make the volume ratio thereof greater than 60%.

Moreover, the particle diameter of each of the fine particles 3 of low surface energy resin in the composite plating 4, is to be between 0.05 μm and 15 μm. It is technically difficult to make a particle diameter of each of fine particles of low surface energy smaller than 0.05 μm, and the fine particles each having a particle diameter smaller than 0.05 μm is also not available in market. That is, the lower limit of the particle diameter is set at 0.05 μm, due to the technical and economical reasons from the view point of execution. Moreover, the reason for setting 15 μm to be the upper limit of the particle diameter of each of the fine particles 3 of low surface energy resin is as follows. When the diameter exceeds this upper limit, the diameter becomes close to the particle diameter of each of the super hard particles. As a result, a thickness of the plating becomes thicker, and the surface roughness of the jacket becomes small, causing ink to adhere to the surface of the jacket. Accordingly, the jacket is smeared.

As described above, by using the fine particles 3 of low surface energy resin in the composite plating 4, the low surface energy properties of the surface of the composite plating 4 is secured. That is, the properties for keeping ink away from the surface and easily repelling the ink are secured.

Moreover, since the fine particles of low surface energy resin are retained by the metal matrix in the composite plating 4, the composite plating 4 is hardly separated therefrom or worn out. Since the surface other than those formed of the fine particles 3 of low surface energy resin is of the plating metal matrix (for example, Ni—P), paper dust, other dust, or the like hardly enters therein. Furthermore, since the surface other than those formed of the fine particles 3 of low surface energy resin is of the matrix of the plating which is of the plating metal matrix (for example, Ni—P), it has electric conductivity and hardly charged. Accordingly, paper dust, other dust or the like is hardly adsorbed thereto.

Figure 5:
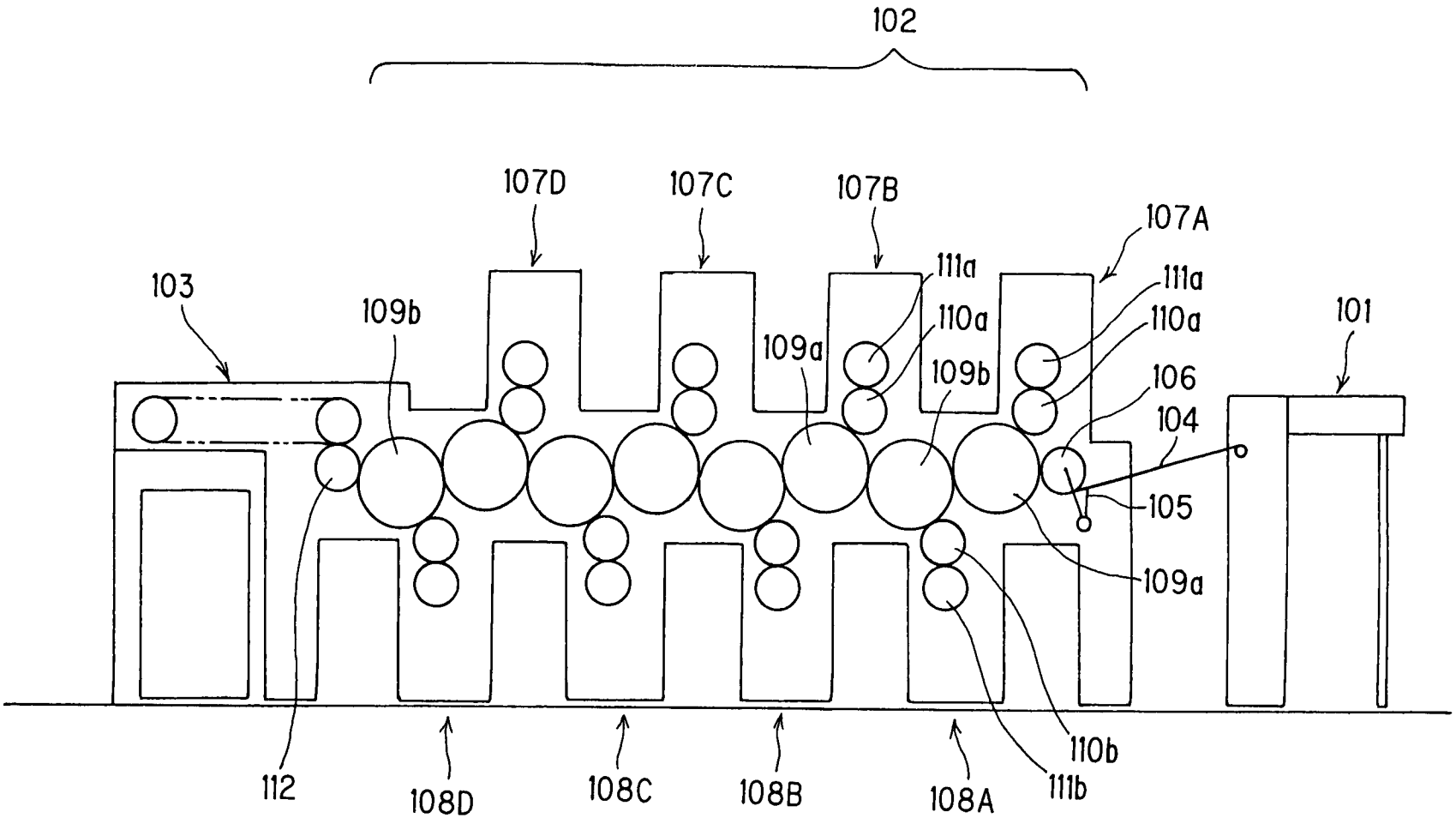
FIG. 5 is a schematic side view of an example of a printing press to make two-sided prints.
Figure 6:
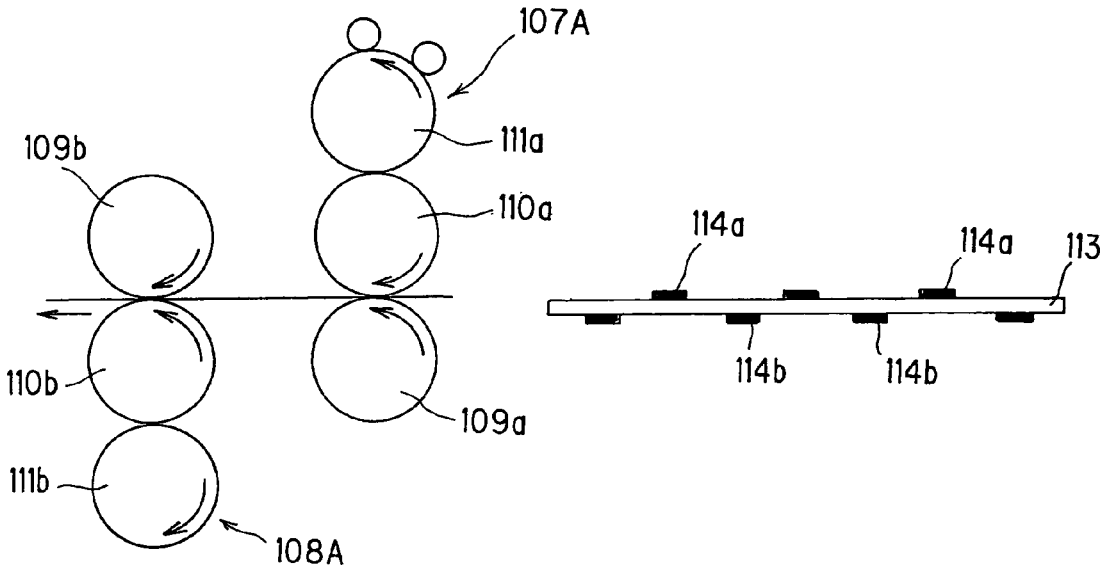
FIG. 6 is a schematic diagram for the purpose of explaining adhesion of ink to an impression cylinder.
Figure 7:
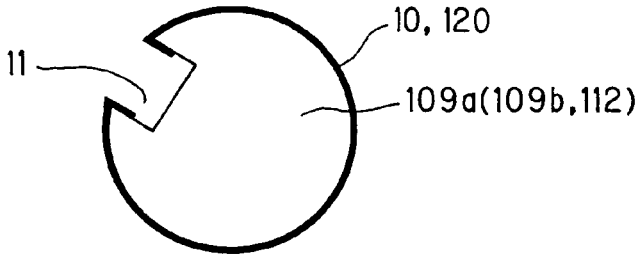
FIG. 7 is a schematic view of an impression cylinder or a transport cylinder on which a jacket is installed thereon.
Figure 8:
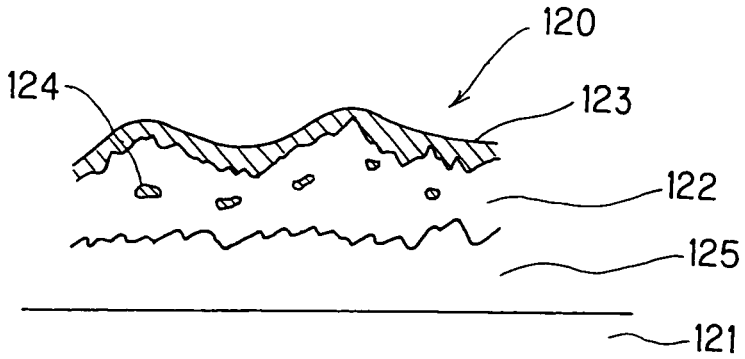
FIG. 8 is a partial cross sectional view of a conventional jacket.

In a case where jackets 10 obtained in the manner described above are applied to the printing press shown in FIG. 5, the jackets 10 are installed on the impression cylinders 109*a* subsequent to that of the front side printing unit 107B, the impression cylinders 109*b* of all the back side printing units 108A to 108D, and the transport cylinder 112, respectively. The installation is carried out, for example, as shown in FIG. 7, in a way that both ends of the jacket 10 are inserted into a groove 11 of the impression cylinder 109*a* (109*b*) and the transport cylinder 112, and then the jacket 10 is stretched and retained by a retaining device (not shown) provided in a groove 11.

In a case where two-sided prints are made by a printing press in which the impression cylinders and transport cylinder respectively having these jackets 10 installed thereon, the print is made as follows. When a sheet of paper is pressed toward the blanket cylinder, and when the sheet of paper is transferred, the sheet of paper is brought into contact with the convex portions formed by the convex and concave profile of the super hard particles 2. The convex portions are brought into contact with the sheet of paper at the tips of the convex portions (tips 2*a* of the super hard particles 2), each of which is a minimum point. For this reason, even when ink adheres to the tips, due to a point-contact effect, the sheet of paper coming to be processed next is barely smeared, and thus no influence on the printing quality is given. While the ink adheres only to the tips 2*a* of the super hard particles 2, a white spot (a portion where ink does not exist) is generated on a portion of printing surface, which corresponds to each of the tips 2*a*. The white spot is small enough not to attract attention when viewed by a naked eye, and there is no problem for a printed material.

Furthermore, when a different print is to be made, in a case where a portion of the sheet of paper corresponding to each of the tips 2*a* of the super hard particles 2, the portion being attached to the ink, is a picture portion, there is no problem since the ink does not adhere to the portion anymore. In a case where the portion of the sheet of paper is not the picture portion, the ink which has adhered to each of the tips 2*a* of the super hard particles 2 is transferred to the printed material. The ink on the printed material is then taken away therewith during a test run. Thus, it does not become a problem at the time of a press run.

It should be noted that when the tips 2*a* of the super hard particles 2 are sharp, holes are made on a thin paper during a printing process on the thin paper. In addition, scratches are generated on solid portions, which possibly damage the print material. As in the case of this example, however, when using roundish or spherical ceramic particles as the super hard particles, these problems do not occur.

The surface of the jacket 10 is formed of the super hard particles 2 and the composite plating 4. For this reason, the surface is resistant to the adhesion of paper dust or other dust during printing processes. Moreover, since the surface hardly charges electrostatics, the surface hardly adsorbs paper dust or other dust. Accordingly, the ink smearing is unlikely generated on the jacket 10 from these points of view.

In a case where the impression cylinders 109*a* and 109*b* or the transport cylinder 112, respectively on which the jackets 10 described above are installed are adopted, it is possible to prevent the occurrence of ink smearing for a long period of time. That is, a time period of its continuous operation without washing is required is extended, and thus, the productivity of printing can be improved. In a case where ink smearing occurs, the impression cylinders 109*a* and 109*b* or the transport cylinder 112 are to be washed. However, the super hard particles 2 and the fine particles 3 of low surface energy resin are firmly retained by the metal matrix of the plating. For this reason, the super hard particles 2 and the fine particles 3 are not separated or removed from the plating by the washing. Furthermore, when the surface of the composite plating 4 is worn out, the fine particles 3 of low surface energy under the surface are newly exposed. For this reason, the resistance properties thereof are maintained, and also the smearing on the convex portions can be easily washed.

Moreover, with this jacket 10, the base member which has been used once can be used again. This is because the plating can be removed by performing a reversed process of the aforementioned manufacturing process.

Example 2

Figure 2:
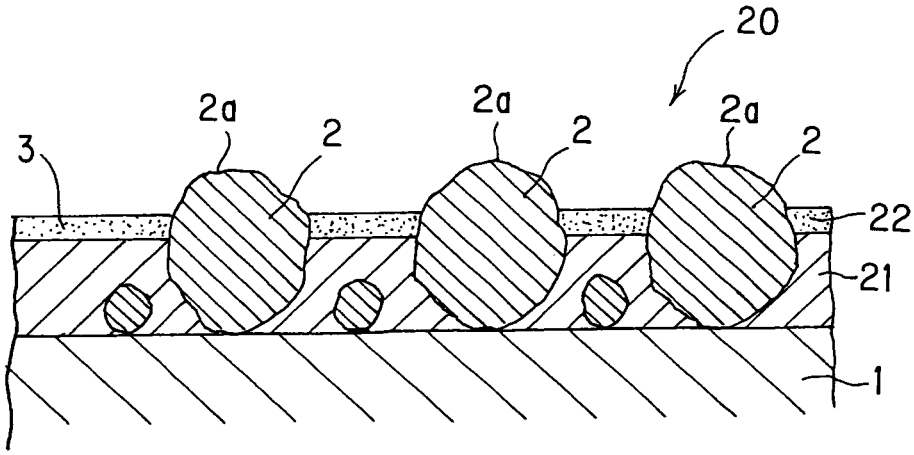
FIG. 2 is a partial cross sectional view of a jacket according to another example (Example 2) of the present invention, for an impression cylinder or a transport cylinder of a printing press.

As shown in FIG. 2, a jacket 20 according to this example is the same as that of Example 1 as to the following point. Both of the jackets 10, 20 are formed in the same manner that the super hard particles 2 such as ceramic particles are scattered on the base member 1. In this example, however, the super hard particles 2 are first fixed onto the base member 1 by nickel (Ni) plating (first plating), instead of coating the surface with the composite plating where the fine particles of low surface energy resin is dispersed. The super hard particles 2 are firmly fixed onto the base member 1 by this nickel plating layer (a first plating layer) 21. Next, a composite plating (a second plating) using nickel-phosphorus (Ni—P) containing PTFE fine particles 3 is processed thereon in a manner where a half or more of the height of each of the super hard particles 2 is covered. In this case, a nickel-phosphorus plating layer (a composite plating layer) 22 formed by the second plating can be thin. It is thus possible to reduce usage of the expensive PTFE.

Material, particle diameter and distribution of the super hard particles 2 used in this example are the same as those in Example 1. Furthermore, material, particle diameters, degree of distribution, and the like of fine particles of low surface energy resin in the second plating layer 22 are also the same as those in Example 1.

Example 3

Figure 3:
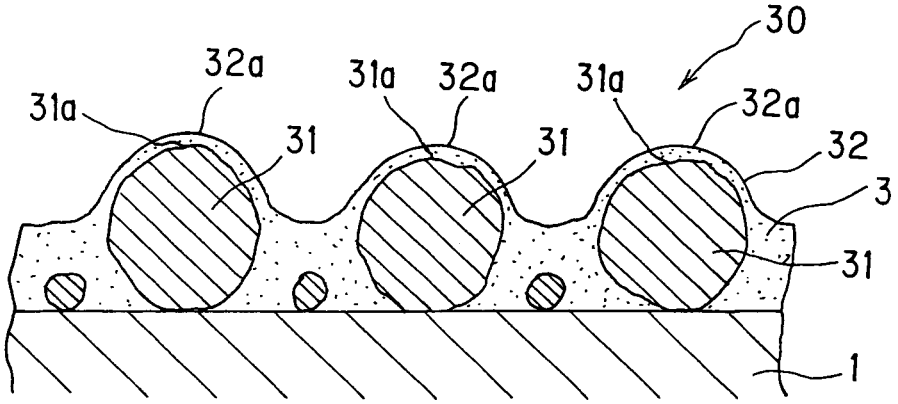
FIG. 3 is a partial cross sectional view of a jacket according to still another example (Example 3) of the present invention, for an impression cylinder or a transport cylinder of a printing press.

As shown in FIG. 3, a jacket 30 according to this example is configured in a manner that a top surface portion of each super hard particle 31 is coated with a plating layer. This structure is formed as follows. Corroded ceramic particles 31 are scattered onto the base member 1. Subsequently, a composite plating 32 is formed thereon, in which the fine particles of low surface energy resin are uniformly dispersed.

As shown in FIG. 3, the surface of each of the ceramic particles 31 is coated with the composite metal layer 32, and a convex and concave profile is formed as a whole. In this example, material of the base member 1, the low surface energy resin, and metal material forming the composite plating 32 containing the fine particles, are same as those in Example 1. Furthermore, particle diameters and the average particle size of the ceramic particles 31, and a volume ratio of the low surface energy resin in the composite plating 32, particle diameters of the fine particles of the low surface energy resin, and the like, are the same as those in Example 1.

In a case where impression cylinders or a transport cylinder using the jackets 30 according to this example, points (top portions 32*a*) coated with a thin film of the composite plating 32 of the ceramic particles 31 are brought into contact with a print medium such as paper or cloth. These portions 32*a* also have low surface energy properties. For this reason, even if they are brought into contact with printed surface of the print medium, these portions repel ink, and thus the ink is not transferred thereto. As a result, subsequent printed materials are not smeared by these portions. What coats the top portions 32*a* is the composite plating which is not a mere low surface energy resin. For this reason, the plating also has anti-wear properties and achieves a function of being resistant to ink and of repelling the ink for a long period of time.

Even in a case where the ceramic particles 31 are exposed when the tip portions 32*a* are worn out, the smearing on the printed material is prevented. This is because, since each of tips 31*a* of the ceramic particles 31 is a minimum point, these portions 31*a* function in the same manner as that explained in the case of Example 1.

Example 4

Figure 4:
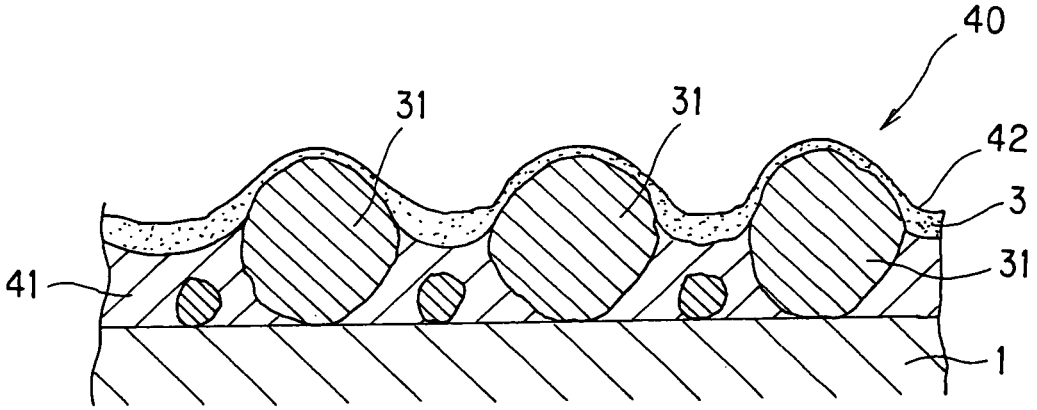
FIG. 4 is a partial cross sectional view of a jacket according to yet another example (Example 4) of the present invention, for an impression cylinder or a transport cylinder of a printing press.

As shown in FIG. 4, in a jacket 40 according to this example, the corroded ceramic particles 31 are used. Additionally, as in the example shown in FIG. 2, first, the ceramic particles are fixed onto the base member 1 by the metal plating only. Then, the composite plating containing the fine particles of low surface energy resin is processed to coat thereon in a manner where the tips of the ceramic particles 31 are also covered with the plating.

As shown in FIG. 4, the corroded ceramic particles 31 are scattered on the base member 1. Next, nickel plating (a first plating) is processed on the base member 1. A nickel plating layer (a first plating layer) 41 is processed in a manner where a half or more of each height of the ceramic particles 31 having an average particle diameter is covered. In order to perfect the fixation of the ceramic particles 31, 55% to 65% of height of each of the ceramic particles 31 is desirably buried in the first plating layer as in the other examples. In the state where the nickel plating layer 41 is formed, tip portions of the ceramic particles 31 are in a state of being protruded from the nickel plating layer 41. Accordingly, a number of tip portions of the ceramic particles 31 form a convex and concave profile.

Subsequently, composite plating (a second plating) of nickel-phosphorus (Ni—P) plating containing the PTFE fine particles is processed on the nickel plating layer 41. A composite plating layer (a second plating layer) 42 can be formed on the surfaces of the ceramic particles, because the ceramic particles 31 can be plated That is, the convex and concave profile coated with the composite plating layer 42 containing the PTFE fine particles 3 is formed.

In this example, particle diameters and the average particle size of the ceramic particles 31, and a volume ratio of the low surface energy resin in the composite plating 42, particle diameters of the fine particles of low surface energy resin, and the like are the same as those in Example 1. Furthermore, as a material of the base member 1, and another material of the composite plating layer 42, the same materials as those cited in Example 1 can be adapted.

In this example, the second plating layer 42 can be thin in comparison with the one in the case of Example 3. For this reason, a usage of the expensive PTFE can be reduced. Operation effects of preventing the smearing caused by ink and of preventing the smearing of the printed material, in a case where the jacket according to this example is used, are the same as those in Example 3.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A jacket for any one of impression cylinders and transport cylinders of a printing press, which is wound therearound and installed thereon for preventing ink from adhering thereto, comprising:

a sheet-shaped base member;

super hard particles scattered over a surface of the sheet-shaped base member, such that a space is provided between adjacent super hard particles; and a metal plating layer plating the surface of the base member by composite of plating containing fine particles of ink-resistant and ink-repellent low surface energy resin in metal matrix to fix the super hard particles on the surface of the base member in a way that a convex and concave profile formed by the super hard particles is left, wherein the super hard particles are fixed to the sheet-shaped base member by the metal plating layer including the fine particles.

2. The jacket for any one of impression cylinders and transport cylinders of a printing press according to claim 1, wherein the super hard particles are either exposed from the metal plating layer or coated with the metal plating layer.

3. The jacket for any one of impression cylinders and transport cylinders of a printing press according to claim 1, wherein surface roughness, which is denoted by Rz, is 5 μm to 40 μm.

4. The jacket for any one of impression cylinders and transport cylinders of a printing press according to claim 1, wherein an average particle diameter of the super hard particles is between 3 μm and 30 μm.

5. The jacket for any one of impression cylinders and transport cylinders of a printing press according to claim 1, wherein an amount of the fine particles of low surface energy resin in the composite of plating is 10% to 60% of an amount of the plating in volume ratio.

6. The jacket for any one of impression cylinders or transport cylinders of a printing press according to claim 1, wherein each of the particle diameters of the fine particles of low surface energy resin is between 0.05 μm and 15 μm.

7. The jacket for any one of impression cylinders and transport cylinders of a printing press according to claim 1, wherein each of the super hard particles has one of a roundish shape and a spherical shape.

8. The jacket for any one of impression cylinders or transport cylinders of a printing press according to claim 1, wherein the metal plating layer is applied directly on the super hard particles.

9. The jacket for any one of impression cylinders or transport cylinders of a printing press according to claim 1, wherein super hard particles are fixed to the sheet-shaped base member by the metal plating layer.

10. The jacket for any one of impression cylinders or transport cylinders of a printing press according to claim 1, wherein the metal plating layer is a composite plating layer whose matrix is metal.

11. A jacket for any one of impression cylinders and transport cylinders of a printing press, which is wound therearound and installed thereon for preventing ink from adhering thereto, comprising:

a sheet-shaped base member;

super hard particles scattered over a surface of the sheet-shaped base member, such that a space is provided between adjacent super hard particles, a first metal plating layer fixing the super hard particles onto the base member, and a second plating layer plating a surface of the first metal plating layer by composite of plating containing fine particles of ink-resistant and ink-repellent low surface energy resin in metal matrix a way that a convex and concave profile formed by the super hard particles is left, wherein the super hard particles are fixed to the sheet-shaped base member by the first metal plating layer and the second plating layer.

12. The jacket for any one of impression cylinders and transport cylinders of a printing press according to claim 11, wherein the super hard particles are either exposed from the second plating layer or coated with the second plating layer.

13. The jacket for any one of impression cylinders and transport cylinders of a printing press according to claim 11, wherein surface roughness, which is denoted by Rz, is 5 μm to 40 μm.

14. The jacket for any one of impression cylinders and transport cylinders of a printing press according to claim 11, wherein an average particle diameter of the super hard particles is between 3 μm and 30 μm.

15. The jacket for any one of impression cylinders and transport cylinders of a printing press according to claim 11, wherein an amount of the fine particles of low surface energy resin in the composite of plating is 10% to 60% of an amount of the plating in volume ratio.

16. The jacket for any one of impression cylinders or transport cylinders of a printing press according to claim 11, wherein each of the particle diameters of the fine particles of low surface energy resin is between 0.05 μm and 15 μm.

17. The jacket for any one of impression cylinders and transport cylinders of a printing press according to claim 11, wherein each of the super hard particles has one of a roundish shape and a spherical shape.

18. The jacket for any one of impression cylinders or transport cylinders of a printing press according to claim 11, wherein the second plating layer is applied directly on the super hard particles.

19. The jacket for any one of impression cylinders or transport cylinders of a printing press according to claim 11, wherein the second plating layer is a composite of plating whose matrix is metal.

* * * * *